US007281481B2

(12) United States Patent
Rising et al.

(10) Patent No.: US 7,281,481 B2
(45) Date of Patent: Oct. 16, 2007

(54) WATERTIGHT DOOR

(76) Inventors: Benjamin E. Rising, 36 White Oak Rd., Woodbury, CT (US) 06798; Elilot J. Wiener, 318 Golf Dr., Oceanside, NY (US) 11572

( * ) Notice: Subject to any disclaimer, the term of this patent is extended or adjusted under 35 U.S.C. 154(b) by 0 days.

(21) Appl. No.: 11/460,739

(22) Filed: Jul. 28, 2006

(65) Prior Publication Data

US 2007/0022662 A1 Feb. 1, 2007

Related U.S. Application Data

(60) Provisional application No. 60/704,216, filed on Aug. 1, 2005.

(51) Int. Cl.
*B63B 19/00* (2006.01)

(52) U.S. Cl. ..... 114/117; 49/395

(58) Field of Classification Search ..... None
See application file for complete search history.

(56) References Cited

U.S. PATENT DOCUMENTS 2,103,291 A * 12/1937 Lambert
2,197,824 A * 4/1940 Young ..... 114/117
2,264,426 A * 12/1941 Young ..... 114/117
2,511,267 A * 6/1950 Jacob
4,114,424 A * 9/1978 Johnson ..... 114/117
4,665,653 A * 5/1987 Franz
5,156,359 A * 10/1992 Noble
5,199,369 A * 4/1993 Meyer et al. ..... 114/117
6,640,498 B1 * 11/2003 Groeneveld ..... 49/395
6,675,536 B1 * 1/2004 Williams
6,799,396 B1 * 10/2004 Redfern
6,871,448 B1 * 3/2005 Kline
7,051,897 B2 * 5/2006 McGuire
2002/0129556 A1 * 9/2002 Keuken

* cited by examiner

*Primary Examiner*—Lars A. Olson
(74) *Attorney, Agent, or Firm*—Michael A. Blake

(57) ABSTRACT

A watertight door comprising: a door frame; a door panel, with a perimeter normally adjacent to the door frame when the door is closed, and with a first facing side and a second facing side, configured to open and close within the door frame; a first gasket lip seal generally encircling the perimeter and nearer to the first facing side, the first gasket lip seal having a base section, sealing section, and bending section; a second gasket lip seal generally encircling the perimeter, nearer to the second facing side, and adjacent to the first gasket lip seal, the second gasket lip seal having a base section, sealing section and bending section; a plurality of extension pin sleeves located perpendicular to the perimeter; a plurality of extension pins moveably housed in the plurality of extension pin sleeves; a plurality of gasket retraction plates located generally about the perimeter, and in communication with the plurality of pins; a plurality of springs located in the extension pin sleeves, and configured to push the extension pins and gasket retraction plates towards the door frame; a gasket retraction plate retraction means in operable communication with the gasket retraction plates; wherein the gasket retraction plate retraction means is configured to retract the gasket retraction plates towards the center of the door panel thereby impinging the first gasket lip seal and the second gasket lip seal such that both gasket lip do not form a seal with the door frame, and wherein the gasket retraction plate retraction means is further configured to release the gasket retraction plates such that the first gasket lip seal and the second gasket lip seals are no longer impinged by the gasket retraction plates and thus both the first and second gasket lip seals each form a seal on the door frame.

7 Claims, 6 Drawing Sheets

WATERTIGHT DOOR

CROSS-REFERENCES

The present application claims the benefit of Provisional Patent Application No. 60/704,216, filed on Aug. 1, 2005 by Benjamin E. Rising.

TECHNICAL FIELD

The disclosed invention relates to a watertight door and a closing mechanism for the watertight door.

BACKGROUND

Currently, the closing mechanism of watertight doors, which are often used in marine vessels, have a number of latches arranged around the door and these latches are each connected to a rod system. An operating member, such as a lever or a turning wheel, is also connected to this rod system, in order to operate each latch simultaneously by operating the operating member.

In order to properly seal the prior art watertight doors, a large amount of force is required to compress one or more gaskets to obtain a watertight seal. The typical hinged watertight door found on Navy vessels utilizes a "compression gasket" for sealing. This arrangement requires about 30 lbs of compression force per linear inch of gasket. For a 30"×66" door, this translates to 5760 lbs of force that has to be generated by the latches. This large compression force often necessitates a complicated latch mechanism to produce the mechanical advantage required for manual operation. The high loading, due to the large compression force required, results in worn parts and frequent maintenance, particularly for high traffic doors. The high loading also forces the mechanism to be bulky which adds significantly to the overall weight of the door. The typical gasket for the prior art door has a very small tolerance for variations in flatness. This requires the door panel and frame to be stiff and heavy to limit deformation under load that would compromise the seal. It also makes prior art doors very sensitive to welding distortion that may occur during the installation process. Additionally, the prior art doors usually require a raised threshold to function. Also, the mechanism on most prior art doors is external and exposed. This makes the prior art door aesthetically obtrusive and prone to tampering and external damage.

The typical prior art door has been described by the Navy as "heavy, unreliable and very expensive to maintain over the life cycle of the ship".

Thus, there is a need for a watertight door and closing mechanism for a watertight door that overcome the above listed and other disadvantages of prior art watertight doors.

SUMMARY

The disclosed invention relates to a watertight door comprising: a door frame; a door panel, with a perimeter normally adjacent to the door frame when the door is closed, and with a first facing side and a second facing side, configured to open and close within the door frame; a first gasket lip seal generally encircling the perimeter and nearer to the first facing side, the first gasket lip seal having a base section, sealing section, and bending section; a second gasket lip seal generally encircling the perimeter, nearer to the second facing side, and adjacent to the first gasket lip seal, the second gasket lip seal having a base section, sealing section and bending section; a plurality of extension pin sleeves located perpendicular to the perimeter; a plurality of extension pins moveably housed in the plurality of extension pin sleeves; a plurality of gasket retraction plates located generally about the perimeter, and in communication with the plurality of pins; a plurality of springs located in the extension pin sleeves, and configured to push the extension pins and gasket retraction plates towards the door frame; a gasket retraction plate retraction means in operable communication with the gasket retraction plates; wherein the gasket retraction plate retraction means is configured to retract the gasket retraction plates towards the center of the door panel thereby impinging the first gasket lip seal and the second gasket lip seal such that both gasket lip do not form a seal with the door frame, and wherein the gasket retraction plate retraction means is further configured to release the gasket retraction plates such that the first gasket lip seal and the second gasket lip seals are no longer impinged by the gasket retraction plates and thus both the first and second gasket lip seals each form a seal on the door frame.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
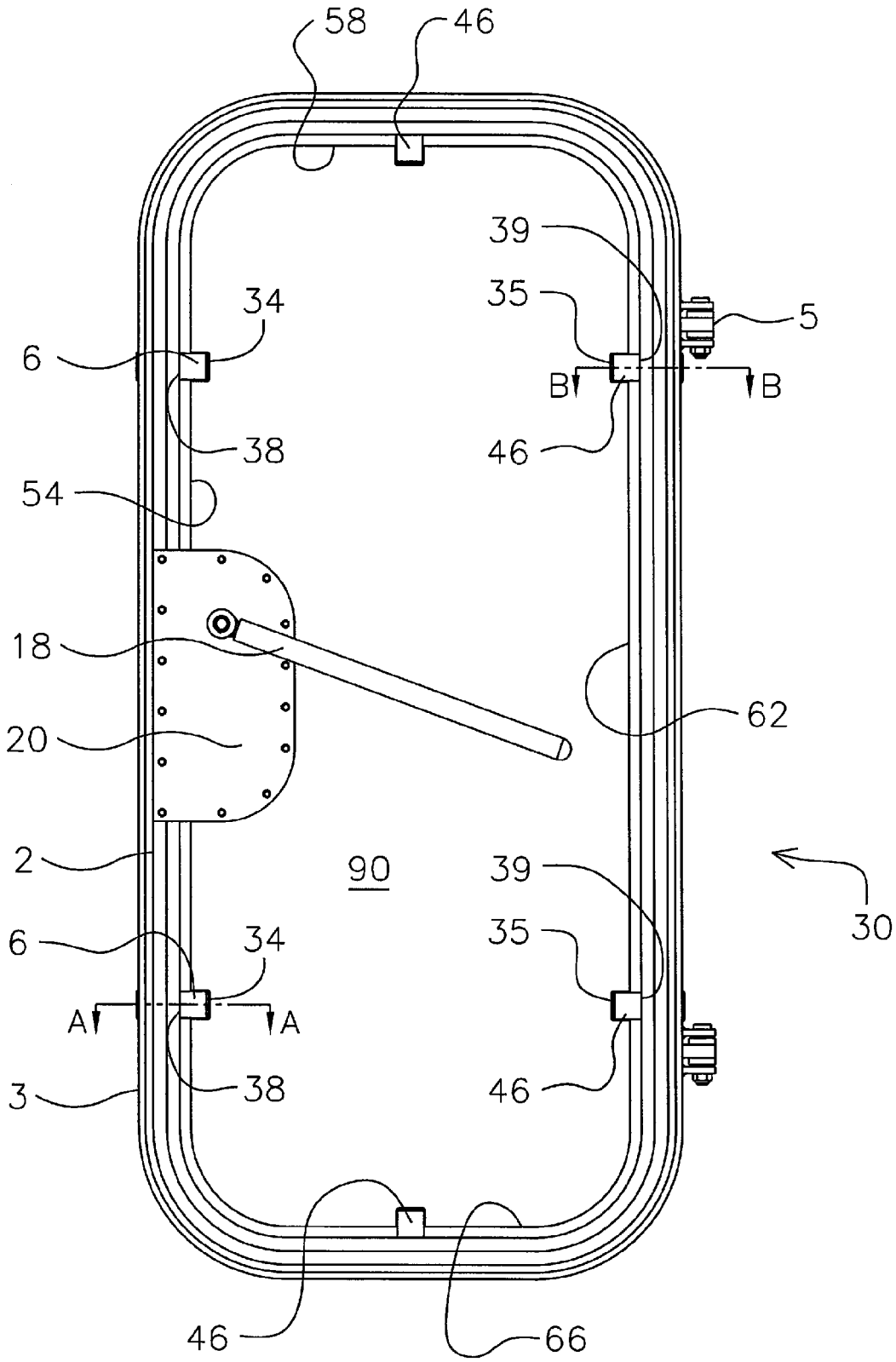
FIG. 1 is a back view of the disclosed watertight door.

A hinged watertight door is a hinged panel and frame assembly that will prevent the passage of water or other fluid when the door is closed and sealed. FIG. 1 discloses a front view of one embodiment of a disclosed watertight door 30. A door panel 2 latches to the frame 3 with retractable latching pins 4 (not visible in this Figure, shown below) located along a side 54 of the door panel 2. The latching pins 4 are located on the side 54 of the door opposite the door hinges 5. The latching pins 4 are housed in latching pin sleeves 6, each of which are closed at a first end 34 and opened at a second end 38. Extension pins 13 (not visible in this view) are located on the three other sides of the door, the top side 58, hinge side 62, and bottom side 66. The extension pins 13 are housed in extension pin sleeves 46. Each of the extension pin sleeves are closed at a first end 35 and opened at a second end 39. The door 30 may separate an interior space from an exterior space, or may separate two interior spaces from each other, therefore one side of the door may face the "outside", and the other the "inside, however, in other situations both sides of the door may face the "inside". Thus, for the purpose of this disclosure, one facing side of the door will be referred to as a first facing side 86 of the door 30 and the other facing side of the door 30 will be referred to as a second facing side 90.

Figure 2:
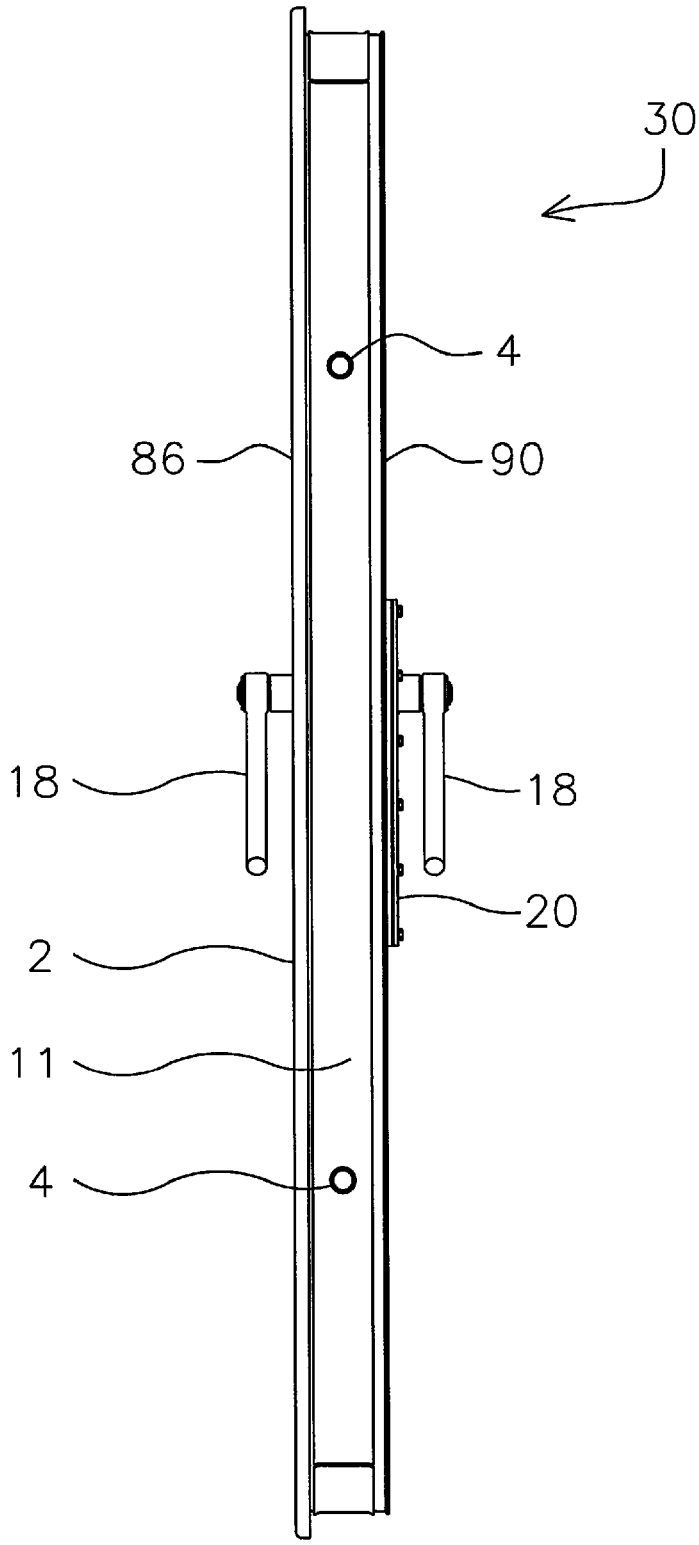
FIG. 2 is a side view of the disclosed watertight door.

FIG. 2 shows a side view of the door panel2. Two of the door pins 4 are visible in this view. A gasket retraction plate 11 is shown, and will be described below. A door operating member 18 is shown in this embodiment. The door operating member 18 is turned to seal and latch or unseal and unlatch the door 30. A removable cover 20 is shown and will be explained in more detail below. The door operating member 18 may be a handle or lever.

Figure 3:
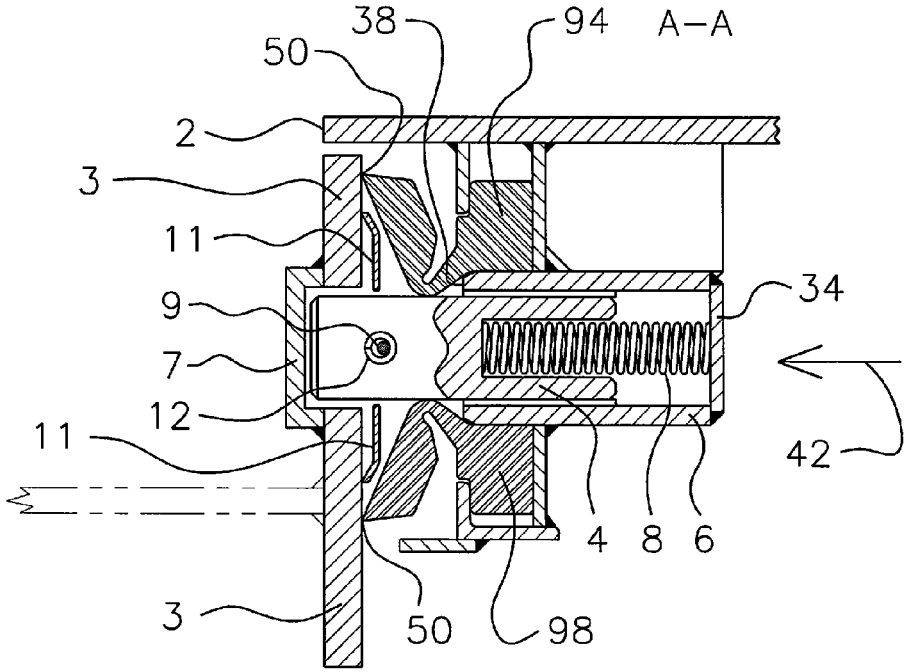
FIG. 3 is a cross-sectional view of the watertight door from FIG. 1 through plane A-A.

FIG. 3 shows a cross-sectional view of the door through plane A-A. In this view the latching pin 4 is shown in latching pin sleeve 6. A pin spring 8 is configured to provide a constant force on the pin 4 in the direction of the arrow 42 so that the pin 4 is being pushed towards the latching pin pocket 7. A cable 9 extends around the perimeter of the door panel 2. The cable 9 passes through each of the latching pins 4. The latching pins 4 have a hole located within them to accommodate the cable 9. A low friction bushing 12 is installed in the hole and extends from the hole and latching pin 6 so that the bushing 12 will impinge the gasket retraction plate 11 as the latching pin 4 moves in the direction of the arrow 42, thereby moving the gasket retraction plate 11 towards the door frame 3. As the gasket retraction plate 11 moves towards the door frame 3, the gaskets 94, 98 impinge the door frame 3 and create a sealing surface 50 with the door frame 3. The gaskets 94, 98 are lip sealing devices that creates seals with the frame 3. Two gaskets 94, 98 encircle the perimeter of the door panel 2 and are configured, when engaged, to form two seals with the frame 3. Each gasket 94, 98 is flexible and is shaped in such a way that fluid pressure coming from the first side 86 of the door will push the sealing edge of the gasket 94 into the frame 3. In this manner the gasket 94 will seal tighter as the fluid pressure increases. Since there are two gaskets 94, 98 around the perimeter of the door panel 2, it does not matter from which direction, the first side 86 of the door 30 or the second side 90 of the door 30, the fluid pressure comes from. Fluid pressure from either side of the door 30 will cause the gasket 94,98 nearest to that side to seal tighter, an advantage that other known watertight doors do not have.

The latching pins 4 engage pockets 7 in the frame when the door is closed and secure. The pins 4 keep the door closed and transfer the hydrostatic load from the door panel to the door frame. The latching pins 4 are located in between the two gaskets 94, 98. The latching pins 4 are acted upon by a spring 8 that provides a force against the closed first end 34 of the pin sleeve 6 and pushes the pin 4 towards the open second end 38 of the pin sleeve 6. The number and location of the latching pins 4 can vary with the size of the door, 30, and the magnitude of the design pressure. The latching pins 4 extend through holes in the gasket retraction plates (as shown in FIG. 3). The cable 9 is threaded through a hole in each latching pin 4. A low-friction bushing 12 will be inserted in the hole of the latching pin 4 to protect the cable 9 from wear. The low friction bushing 12 may be made out of Teflon or any other suitable low friction material.

Figure 4:
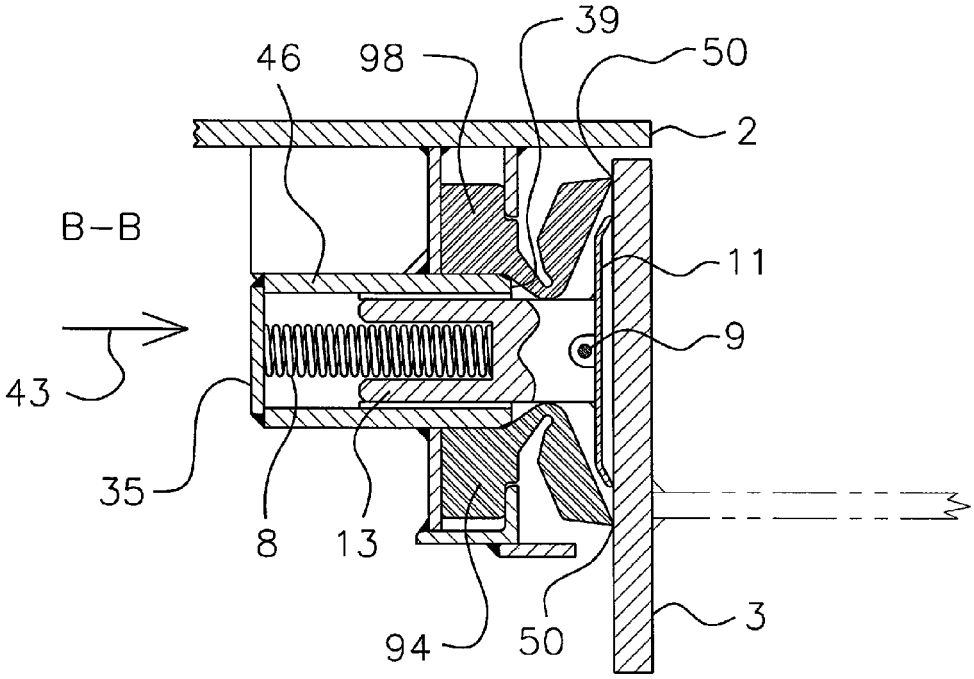
FIG. 4 is a cross-sectional view of the watertight door from FIG. 1 through plane B-B.

FIG. 4 shows a cross-sectional view of the door through plane B-B. In this view, extension pin 13 is shown in extension pin sleeve 46. A spring 8 is pushing the extension pin towards the open second end 39 of the extension pin sleeve 46 in the direction of the arrow 43. One difference between the extension pins 13 and the latching pins 4, is that the extension pins 13 are directly coupled to the gasket retraction plates 11. The cable 9 goes through each of the extension pins 13. The extension pins 13 have a hole located within them to allow the cable 9 to pass through the pins 13. As the gasket retraction plate 11 moves towards the door frame 3, the gaskets 94, 98 impinge the door frame 3 and create a sealing surface 50 with the door frame 3.

Figure 5:
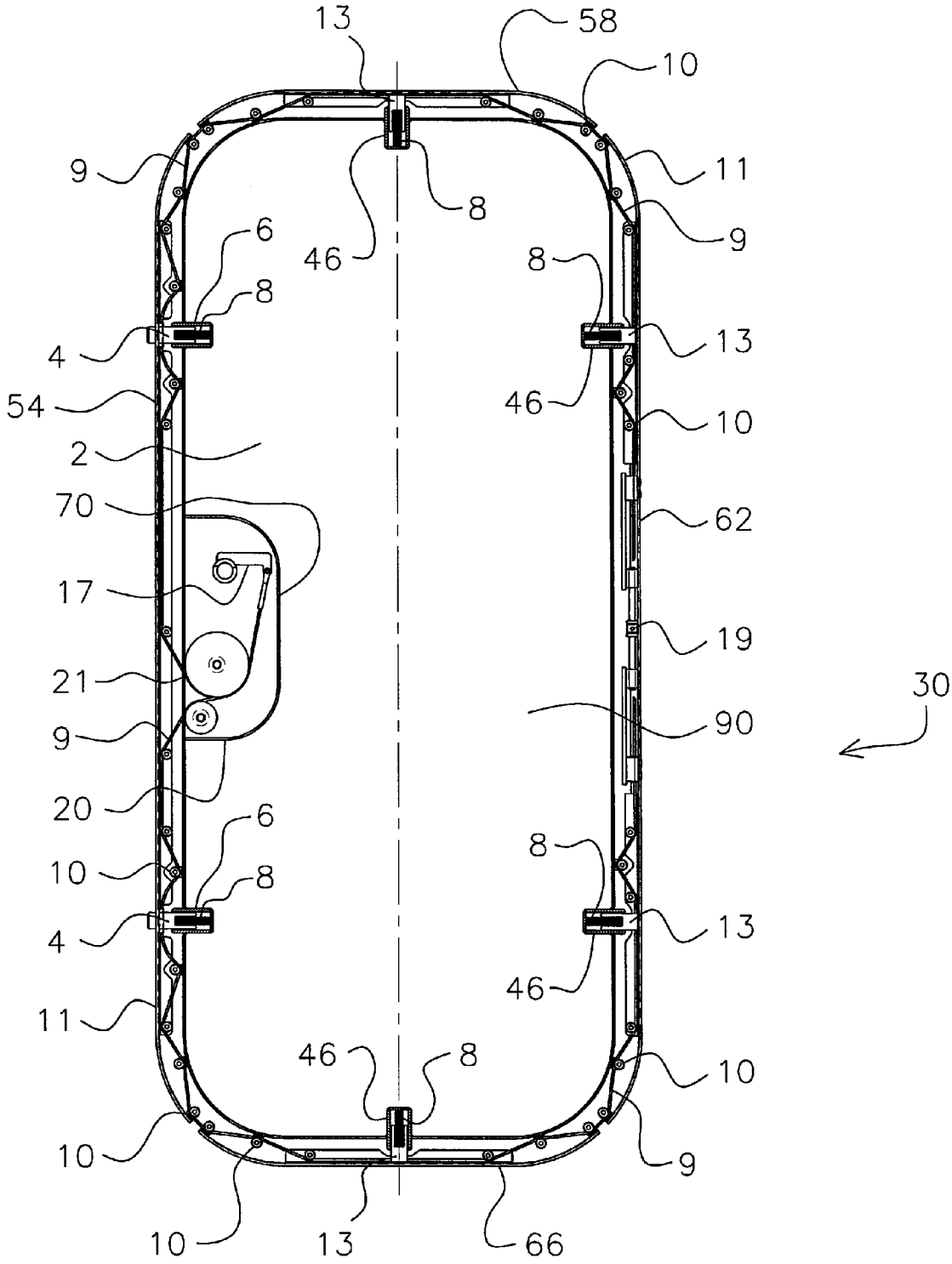
FIG. 5 is a front schematic view of the watertight door in an sealed and latched mode.

FIG. 5 shows a front schematic view of the watertight door 30. The watertight door 30 is shown in an latched (extended or sealed) position. The two gaskets 94, 98 (not visible in this view) are mounted to the panel 2 perimeter and seal out against the frame 3 (the frame 3 is not shown in this view, but would be located adjacent and outside of the gasket retraction plates 11). Each gasket 94, 98 is flexible and is shaped in such a way that the fluid pressure from the first side 86 pushes the sealing edge of gasket 94 into the frame 3, and the fluid pressure from the second side 90 pushes the sealing edge of gasket 98 into the frame 3. In this manner the gaskets 94, 98 will seal tighter as the fluid pressure increases on either side of the door 30. A wire cable 9 or similar item (such as a wire, belt, strap, wire rope, etc.) is located around the perimeter of the door between the two lip seal gaskets 94, 98(not seen in this Figure). The cable 9 runs over rollers 10 or other items that will reduce friction and protect it from wear. A plurality of the rollers 10 are in communication to the gasket retraction plates 11, which are located around the perimeter of the door and adjacent to the lip seal gaskets. Some of the rollers 10 are not in communication with gasket retraction plates 11 and are attached to the door panel structure 2.

The extension pins 13 are required for the purpose of extending the gasket retraction plates 11 on the other three sides 58, 62, 66 of the door 30. These extension pins may be welded to the inside of the gasket retractions plates 11 and do not engage the frame 3 (not visible in this FIG. 5). The spring 8 behind each extension pin 13 will push the extension pin 13 and therefore also the gasket retraction plates 11 out towards the frame 3 when the door 30 is latched.

Figure 6:
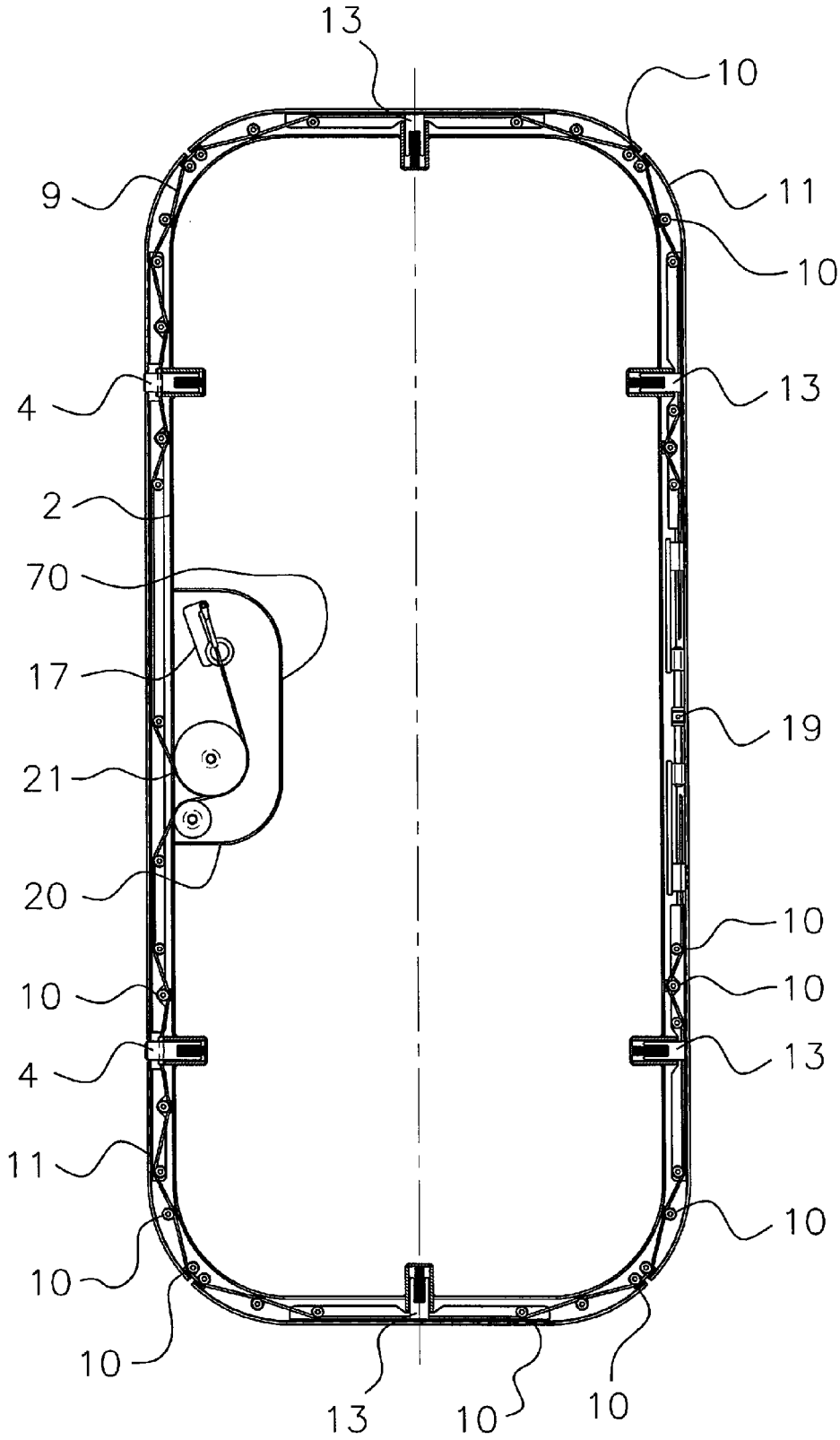
FIG. 6 is a front schematic view of the watertight door in an unsealed and unlatched mode.

The latching and unlatching of the door 30 is performed by the tightening and loosening of the cable 9. The cable is weaved alternately through rollers 10 attached to the gasket retraction plates 11 and to the door panel 2. As it is tightened, both the gasket retraction plates 11 and the latching pins 4 and extension pins 13 are pulled towards the center of the door panel 2. As the gasket retraction plates 13 are pulled back, they contact the two lip seal gaskets 94, 98 and push them away from the frame 3. In this manner, the gaskets 94, 98, latching pins 4, and extension pins 13 are retracted simultaneously. The system is sized so that when the latch pins 4 and gaskets 94, 98 are fully retracted, clearance will exist between the door panel and frame 3 and the door can be opened. FIG. 6 shows a front schematic view of the watertight door 30 in an unlatched (retracted) position. When the cable 9 is loosened from the fully unlatched position, the pins and retraction plates 11 will move to their fully extended positions (as shown in FIG. 5) because of the spring 8 located behind each pin. The free position that the gaskets 94, 98 want to be in extends well beyond the sealed position where they contact the frame 3, and thus gaskets 94, 98 each form a seal with the frame 3.

Figure 7:
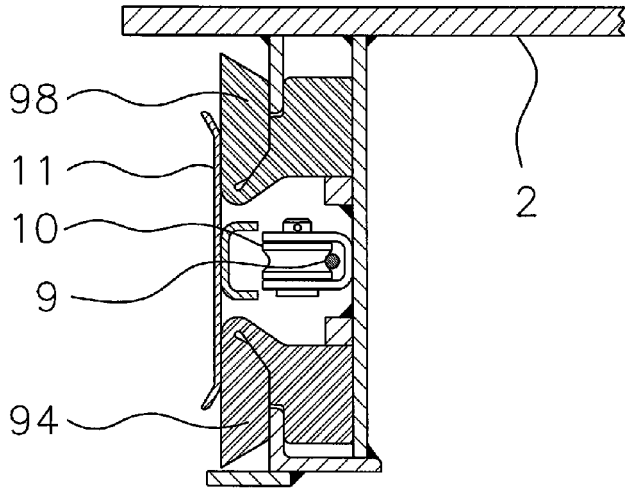
FIG. 7 is cross-sectional view of the watertight door panel with the gaskets fully retracted.

FIG. 7 shows a cross-section of the door panel with the gaskets 94, 98 fully retracted. The gaskets 94, 98 are fully retracted because the gasket retraction plate 11 is impinging on the gaskets 94, 98 and bending them into the retracted shape it takes in FIG. 7.

Figure 8:
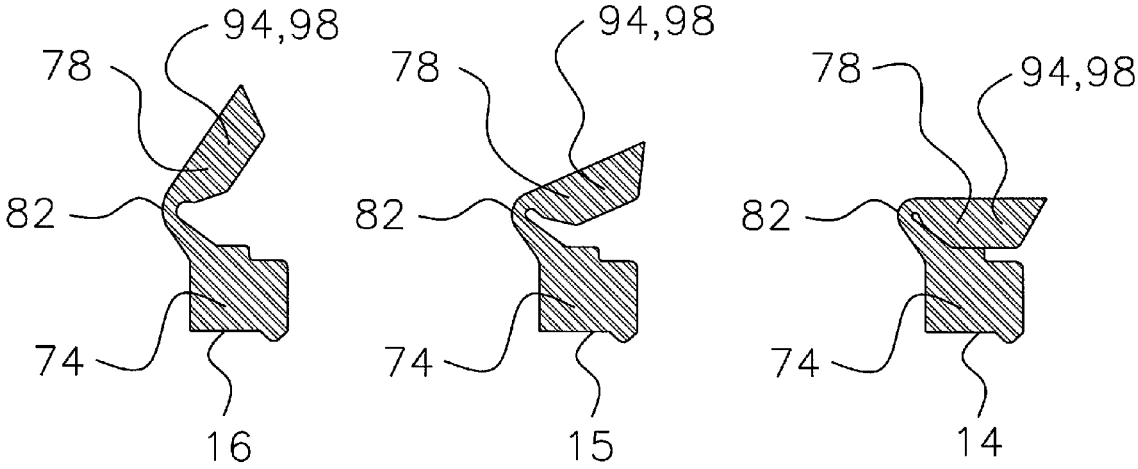
FIG. 8 is a cross-sectional view of the gaskets.

FIG. 8 shows a cross-sectional view of the gasket 94, 98 in the retracted 14, sealed 15 and free 16 positions. Due to the elasticity and memory of the gasket material, the lip seal gasket will want to extend to the free position when the cable is loosened and the retraction plates are released. The gasket may be made from a suitable elastomer, such as, but not limited to silicone or neoprene. The gasket 94, 98 comprises a base section 74, a sealing section 78, and a bending section 82.

The method used for loosening or tightening the cable will depend on the size and requirements of the particular door. The door shown in these Figures is small and manually operated. Referring to FIGS. 5 and 6, the cable 9 is pinned at both ends to an arm 17 that is attached to an operating handle 18. When the operating handle 18 is rotated, the cable 9 is either tightened or loosened, depending on the direction of handle movement. For larger doors, gearing could be added to the system to increase the force developed by the operator. For automated doors, an externally powered actuator such as a hydraulic cylinder or electric actuator could be pinned to the ends of the cable 9 to control the tension, which allows for the handle to be eliminated if so desired.

To obtain uniform actuation, both ends of the wire should be pulled by the actuating device 17. The cable 9 will form a single loop around the door by meeting at a clamping device 19 located on the side 62 opposite the actuating mechanism 17. This clamping device 19 can come in the form of a turnbuckle 19. The turnbuckle 19 will allow small adjustments in the cable tension to be made, to ensure proper actuation of the pins and gasket.

The area of the door panel 2 where the mechanism for pulling the cable is located will be housed in a watertight box 70 (shown in FIGS. 5 and 6) with a removable cover 20 (shown in FIG. 1). Cable sheaves 21 will be used to allow the cable 9 to run from the inside of this box to the door perimeter. The box 70 needs to be watertight to prevent leakage of fluid along the cable path to the region in between the two gaskets.

The mechanism described can be used on watertight closures other than doors, such as hatches and scuttles. The watertight seal is formed with two lip seals on the gaskets 94, 98 that are oriented in opposite directions to withstand fluid pressure from either side of the door The disclosed door and latching mechanism has many advantages. The disclosed hinged watertight door is lighter, less complicated and more compact than existing systems. The mechanism described herein is designed to seal and latch the door through the rotation of a single lever. The door, when closed, will be able to seal against fluid pressure from either side of the door. The mechanism described can be used with any suitable panel and frame material. The disclosed lipseal gasket uses the water pressure to increase its sealing ability and for this reason requires very little initial compression force. The lip seal gasket does require force to be retracted and this is approximately 1.5 lbs/in of gasket. Since there are two gaskets used by the disclosed watertight door, this results in about 3 lbs/in of door perimeter. This means the lip seal actuating mechanism has to produce only one tenth of the force required to actuate an equivalent "prior art" door. This results in the following additional advantages: reduced maintenance (less force applied to the bearings and latches means less wear and less maintenance); and reduced weight (less force required means the mechanism does not have to be as bulky and weight can be saved). The disclosed door offers other advantages that are unrelated to the reduced force requirements, such as easier installation because the watertight door is also more tolerant of variations in the flatness of the door edge than the prior art door. This means the door is easier to install because it is less sensitive to welding distortion on the door frame. The disclosed watertight door is a simpler design. The lip seal mechanism is simpler than most "prior art" designs, resulting in a lower parts count. The disclosed watertight door can seal to a flush floor surface. This means there is no raised threshold to trip over, which is an advantage particularly for land-based applications. Additionally, the mechanism for the disclosed door is internal to the door and hidden from view.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A watertight door comprising:

a door frame;

a door panel, with a perimeter normally adjacent to the door frame when the door is closed, and with a first facing side and a second facing side, configured to open and close within the door frame;

a first gasket lip seal generally encircling the perimeter and nearer to the first facing side, the first gasket lip seal having a base section, sealing section, and bending section;

a second gasket lip seal generally encircling the perimeter, nearer to the second facing side, and adjacent to the first gasket lip seal, the second gasket lip seal having a base section, sealing section and bending section;

a plurality of extension pin sleeves located perpendicular to the perimeter;

a plurality of extension pins moveably housed in the plurality of extension pin sleeves;

a plurality of gasket retraction plates located generally about the perimeter, and in communication with the plurality of pins;

a plurality of springs located in the extension pin sleeves, and configured to push the extension pins and gasket retraction plates towards the door frame;

a gasket retraction plate retraction means in operable communication with the gasket retraction plates;

wherein the gasket retraction plate retraction means is configured to retract the gasket retraction plates towards the center of the door panel thereby impinging the first gasket lip seal and the second gasket lip seal such that both gasket lip do not form a seal with the door frame, and wherein the gasket retraction plate retraction means is further configured to release the gasket retraction plates such that the first gasket lip seal and the second gasket lip seals are no longer impinged by the gasket retraction plates and thus both the first and second gasket lip seals each form a seal on the door frame.

2. The watertight door of claim 1, wherein the gasket retraction plate retraction means comprises:

an extension pin hole located in each of the extension pins;

a cable, with a first end and a second end, that runs through the extension pin hole of each of the extension pins;

an arm attached to the first end and second end of the cable;

wherein the arm is configured such that when it is rotated in one direction, the cable tightens and pulls the pins towards the center of the door panel, and when the arm is rotated in a second direction, the pins are released and are pushed towards the frame by the springs.

3. The watertight door of claim 2, further comprising:

at least one handle attached to the arm;

wherein the watertight door is configured for manual sealing and unsealing of the first and second gasket lip seals with respect to the frame.

4. The watertight door of claim 2, further comprising:

a plurality of first rollers attached to at least one gasket retraction plate and in communication with the cable;

a plurality of second rollers attached to the door panel and in communication with the cable.

5. The watertight door of claim 2, further comprising:

at least one latching pin sleeve located perpendicular to the perimeter;

at least one latching pin moveably housed in the plurality of extension pin sleeves;

at least latching pin pocket located in the door frame and configured to accept the at least one latching pin;

at least one spring located in the at least one latching pin sleeve, and configured to push the at least one latching pin towards the door frame;

a latching pin hole located in the at least one latching pin;

a low friction bushing located in the latching pin hole, configured to communicate with the cable, and further configured to impinge a gasket retraction plate when the latching pin is engaged with the latching pin pocket; and wherein the watertight door is configured such that when the latching pin is engaged with the latching pin pocket, the watertight door is latched to the door frame, and when the latching pin is not engaged with the latching pin pocket, the watertight door is openable with respect to the frame.

6. The watertight door of claim 2, further comprising:

an externally powered actuator in communication with the first and second ends of the cable and configured to tighten the cable when actuated, and to allow the cable to loosen when the actuator is not actuated.

7. The watertight door of claim 2, further comprising:

a turnbuckle in communication with the cable; and wherein the turnbuckle is configured to allow small adjustments to be made to the cable tension.

* * * * *